US006064055A

United States Patent [19]

Dorko

[11] Patent Number: 6,064,055

[45] Date of Patent: May 16, 2000

[54] NIGHT VISION DEVICE HAVING FINE-RESOLUTION IMAGE INTENSIFIER TUBE, MICROCHANNEL PLATE FOR SUCH AN IMAGE INTENSIFIER TUBE, AND METHOD OF MAKING

[75] Inventor: Ronald Dorko, Richardson, Tex.

[73] Assignee: Litton Systems, Inc., Woodland Hills, Calif.

[21] Appl. No.: 09/096,208

[22] Filed: Jun. 11, 1998

[51] Int. Cl.[7] ..... H01J 31/50

[52] U.S. Cl. ..... 250/214 VT; 313/103 R

[58] Field of Search ..... 250/207, 214 VT; 313/103 R, 103 CM, 104, 105 R, 105 CM, 68 R, 68 A, 534, 542; 315/11, 12

[56] References Cited

U.S. PATENT DOCUMENTS 4,086,424 4/1978 Mellen, Sr. .
4,208,577 6/1980 Wang ..... 250/214 VT
4,423,516 12/1983 Mellen, Sr. .
4,518,351 5/1985 Mellen, Sr. .
5,883,380 3/1999 Sinor ..... 313/103 CM
5,949,063 9/1999 Saldana et al. ..... 250/214 VT
5,990,601 11/1999 Orthuber et al. ..... 313/103 CM

*Primary Examiner*—Stephone B. Allen

[57] ABSTRACT

A night vision device (10) includes an improved fine-resolution microchannel plate (22) having a multitude of microchannels (32). The microchannels (32) are defined in groups (32*a*, 32*b*), with each group having plural microchannels. Each group of the microchannels originates with a single fiber pre-form (50) used in a process of manufacturing the microchannel plate (22). A method of making such a microchannel plate (22) is also explained.

18 Claims, 2 Drawing Sheets

NIGHT VISION DEVICE HAVING FINE-RESOLUTION IMAGE INTENSIFIER TUBE, MICROCHANNEL PLATE FOR SUCH AN IMAGE INTENSIFIER TUBE, AND METHOD OF MAKING

BACKGROUND OF THE INVENTION

1. Field of the Invention

The present invention is generally in the field of night vision devices of the light amplification type. More particularly, the present invention relates to an improved night vision device having an image intensifier tube ($I^2T$) which provides fine resolution. A microchannel plate (MCP) of the image intensifier tube has microchannels of a size which may be smaller than that achieved by conventional MCP's and which are less burdensome to manufacture. A method of making such a high-resolution MCP is set out.

2. Related Technology

Even on a night which is too dark for natural human vision, invisible infrared light is richly provided by the stars. Human vision cannot utilize this infrared night time light from the stars because the so-called near-infrared portion of the spectrum is invisible for humans. A night vision device of the light amplification type can provide a visible image replicating the night time scene. Such night vision devices generally include an objective lens which focuses invisible infrared light from the night time scene onto the transparent light-receiving face of an $I^2T$. At its opposite image-face, the image intensifier tube provides an image in visible yellow-green phosphorescent light, which is then presented to a user of the device via an eye piece lens.

A contemporary night vision device will generally use an $I^2T$ with a photocathode behind the light-receiving face of the tube. The photocathode is responsive to photons of infrared light to liberate photoelectrons. These photoelectrons are moved by a prevailing electrostatic field to a microchannel plate having a great multitude of dynodes, or microchannels, with an interior surface substantially defined by a material having a high coefficient of secondary electron emissivity. The photoelectrons entering the microchannels cause a cascade of secondary emission electrons to move along the microchannels so that a spatial output pattern of electrons which replicates an input pattern, and at a considerably higher electron density than the input pattern results. This pattern of electrons is moved from the microchannel plate to a phosphorescent screen by another electrostatic field to produce a visible image.

Those ordinarily skilled in the pertinent arts will understand that the manufacture of conventional microchannel plates involves making a fiber pre-form which includes a round glass core of a type of glass which is etchable and is generally referred to as "core glass". This core glass is placed into the closely fitting bore of a round tube made of a type of glass which can be made electrically active as an emitter of secondary-electrons, and is generally referred to as "cladding glass". 'This fiber pre-form is then heated while a vacuum is applied within the tubular cladding, causing the core and cladding to fuse together. Subsequently, this fused fiber pre-form is drawn (i.e., elongated while heated to a softened condition) to produce an elongate glass fiber of smaller dimension. This fiber is cut into lengths producing a multitude of fine-dimension glass fibers, each of which includes a core of etchable glass and a tubular cladding of electrically active glass.

A great multitude of such glass fibers each including a central fiber or "core" of core glass, and a surrounding cladding of "cladding glass," are stacked together in hexagonal bundles, are fused into a unitary body, and are then further drawn to a smaller size. Importantly, the bundles of fibers used in making a conventional microchannel plate are all composed of identical fibers, each having a core glass strand surrounded by a cladding glass sheath. A plurality of these hexagonal bundles, each including many substantially identical glass fibers, are stacked together within a heavy walled glass tube. This combination of glass tube and hexagonal bundles is commonly referred to as a boule pre-form. This boule pre-form is then fused into a unitary body in a boule-fusion furnace, producing a "boule." Next, the boule is sliced transversely into many thin plates.

Subsequently, each resulting thin plate of glass (i.e., a transverse thin slice of the boule) is subjected to an etching process to remove the core glass from each fiber of the plate. The result is a thin plate of glass having a rim provided by the heavy-walled glass tube and a central field of fine-dimension channels (i.e., microchannels) which extending between opposite faces of the plate. Conventional microchannel plates include as many as eleven million, or more, individual microchannels, each of which is approximately round. Importantly, with conventional microchannel plates, each microchannel requires the formation of a corresponding fine-dimension glass fiber, and there is a one-to-one correspondence of fibers produced from the fiber pre-form, to fibers in the hexagonal bundles, and to microchannels in the finished microchannel plate. This correspondence not only results in a great number of fibers having to be manufactured, but this great number of fibers must also be handled and positioned precisely into the hexagonal bundles during manufacturing of the microchannel plate.

A long-standing effort in night vision technology has been to provide image intensifier tubes that have fine resolution. However, because resolution of the image intensifier tubes is determined in large measure by the number and size (small size being most desirable) of the microchannels in the microchannel plate of the image intensifier tube, there exists a conflict in the conventional technology between providing fine resolution and the manufacturing burden that results from the increasing numbers of fibers that have to be made and handled for such increasingly finer-resolution microchannel plates. The numbers of the fibers required to make a microchannel plate increases, not proportionately, but geometrically with decreasing size of the microchannels in the plate. Thus, the problem of manufacturing burden grows at an expediential rate for conventional technology to provide fine-resolution microchannel plates.

SUMMARY OF THE INVENTION

In view of the deficiencies of the conventional related technology, it is an object of this invention to overcome one or more of these deficiencies. It would be desirable and is an object for this invention to provide a microchannel plate for an image intensifier tube of a night vision device in which less than one fiber pre-form is required to be made for each microchannel of the resulting microchannel plate made from these fiber pre-forms.

Yet another object for this invention is to provide a method of making a microchannel plate having an improved (i.e., finer) resolution of the microchannels of the plate.

Still another objective for this invention is to provide a night vision device having such an improved microchannel plate in an image intensifier tube of the device.

Accordingly, one facet of this invention provides a microchannel plate having a multitude of microchannels each of which is bounded by a wall portion which is substantially a circular segment and is one of several such microchannels cooperatively comprising substantially a complete circle.

Thus, each microchannel of a microchannel plate according to the present invention is one of a group of two or more microchannels which cooperatively define substantially a complete circle, and which group of microchannels originated with a single fiber of core glass and cladding glass together.

An advantage of a microchannel plate according to the present invention is that manufacture of the microchannel plate is considerably simplified and made less burdensome because each fiber of core glass and cladding glass which is prepared at an early stage of the manufacturing process results in at least two microchannels being produced in the finished MCP. Thus, manufacturing of such inventive microchannel plates is considerably less labor-intensive because a smaller number of drawn glass fibers need be handled. Further, microchannel plates with greater numbers of microchannels and with improved resolution can more easily be made by use of the present inventive method.

Other objects, features, and advantages of the present invention will be apparent to those skilled in the art from a consideration of the following detailed description of a preferred exemplary embodiment thereof taken in conjunction with the associated figures which will first be described briefly.

BRIEF DESCRIPTION OF THE DRAWING FIGURES

FIG. 1 is a schematic representation of a night vision device embodying the present invention;

FIGS. 2 and 3 respectively provide an end view and a perspective view, of a fiber pre-form used in making one embodiment of the present invention. It will be noted that in FIG. 2, components of the fiber pre-form arc shown in positions preparatory to their final positions in the fiber pre-form;

FIG. 4 is a fragmentary facial view of a microchannel plate made by use of the fiber pre-form seen in FIGS. 2 and 3; and FIGS. 5 and 6 each provide respective end views of fiber pre-forms according to alternative embodiments of the invention.

DETAILED DESCRIPTION OF EXEMPLARY PREFERRED EMBODIMENTS OF THE INVENTION

While the present invention may be embodied in many different forms, disclosed herein are three specific exemplary embodiments that illustrate and explain the principles of the invention. In conjunction with the description of these embodiments, a method of making the embodiments is described. It should be emphasized that the present invention is not limited to the specific embodiment illustrated.

Figure 1:
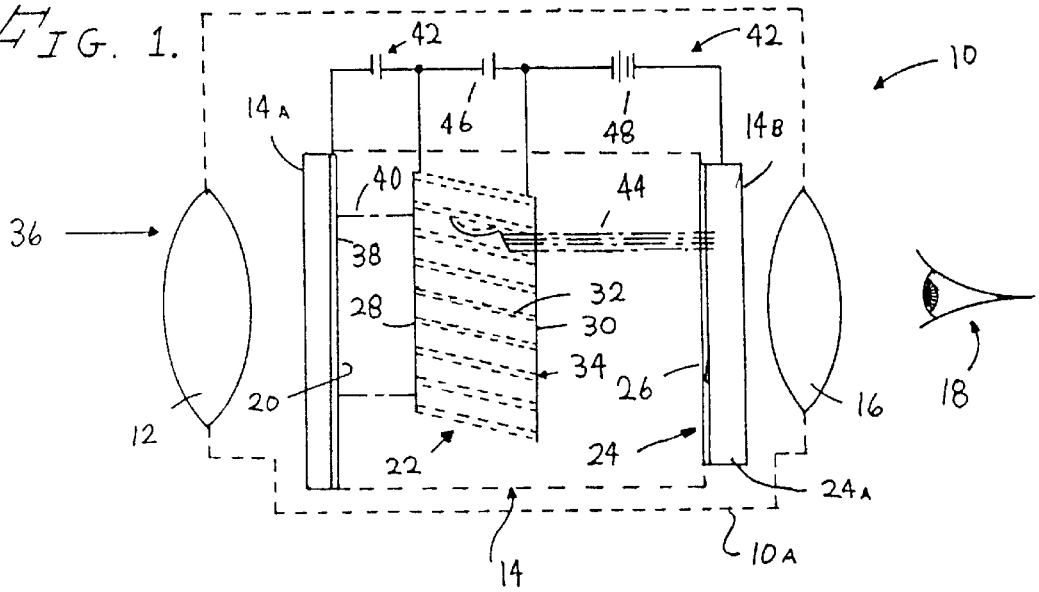

Referring first to FIG. 1, there is shown schematically the basic elements of one version of a night vision device 10 of the light amplification type. Night vision device 10 generally includes a body 10*a*, which is indicated by the dashed-line outline, a forward objective optical lens assembly 12 (illustrated schematically as a functional block element—which may include one or more lens elements). This objective lens 12 focuses incoming light from a distant scene, which may be a night-time scene, on the front light-receiving end 14*a* of an image intensifier tube ($I^2T$) 14. As will be seen, this surface is defined by a transparent window portion of the tube—to be further described below. As was generally explained above, the $I^2T$ provides an image at light-output end 14*b*, for example, in phosphorescent yellow-green visible light, which images replicates the night-time scene. This night time scene would generally not be visible (or would be only poorly visible) to a human's unaided natural vision. The visible image provided by the tube 14 is presented via an eye piece lens illustrated schematically as a single lens 16 to the eye 18 of a human operator, thus producing a virtual image of the rear light-output end of the tube 14 at the user's eye.

More particularly, $I^2T$ 14 includes a photocathode 20 which is responsive to photons of infrared light to liberate photoelectrons in a pattern replicating the scene, a microchannel plate 22 which receives the photoelectrons still in the pattern replicating the night-time scene, and which provides an amplified pattern of electrons also replicating this scene but multiplied by several orders of magnitude, and a display electrode assembly 24. In the present embodiment the display electrode assembly 24 may be considered as having an aluminized phosphor coating or phosphor screen 26. When this phosphor coating is impacted by the electron shower from microchannel plate 22, it produces a visible image replicating the pattern of the electron shower.

Because the electron shower pattern still replicates the scene viewed via lens 12, a user of the device can effectively seen in the dark, by only star light or other low-level illumination which may be present in the ambient environment. A transparent window portion 24*a* of the assembly 24 defines the end 14*b* of the tube 14 and conveys the image from screen 26 outwardly of the tube 14 so that it can be presented to the user 18.

Still more particularly, micro-channel plate 22 is located just behind photocathode 20, with the microchannel plate 22 having an electron-receiving face 28 and an opposite electron-discharge face 30. This microchannel plate 22 further contains a plurality of angulated microchannels 32 which open on the electron-receiving face 28 and on the opposite electron-discharge face 30. Microchannels 32 are separated by passage walls 34.

As explained, the display electrode assembly 24, generally has a conductive coated phosphor screen 26, is located behind microchannel plate 22 with phosphor screen 26 in electron line-of-sight communication with the electron-discharge face 30. Display electrode assembly 24 is typically formed of an aluminized phosphor screen 26 deposited on the vacuum-exposed surface of the optically transparent material of window portion 24*a*. The focusing eye piece lens 16 is located behind the display electrode assembly 24 and allows an observer 18 to view a correctly oriented image corresponding to the initially received low-level image, as was explained above.

As will be appreciated by those skilled in the art, the individual components of $I^2T$ 14 are all mounted and supported in a chambered tube body (indicated with dashed line outline 14*c*), having forward and rear transparent plates cooperating to define a chamber which has been evacuated to a low pressure. This evacuation allows electrons liberated into the free space within the tube to be transferred between the various components by prevailing electrostatic fields without atmospheric interference that could possibly decrease the signal-to-noise ratio.

As indicated above, photocathode 20 is mounted immediately behind objective lens 12 on the inner vacuum-exposed surface of the window portion of the tube and before microchannel plate 22. Typically, this photocathode 20 is a circular disk-like structure having a predetennined construction of semiconductor materials, and is mounted on a substrate in a well known manner. Suitable photocathode materials are generally semi-conductors such as gallium arsenide; or alkali metals, such as compounds of sodium, potassium, cesium, and antimony (commercially available as S-20), carried on a readily available transparent substrate. A variety of glass and fiber optic substrate materials are commercially available.

Considering in somewhat greater detail the operation of the $I^2T$ 14, it is seen that in response to photons 36 entering the forward end of night vision device 10 and passing through objective lens 12 to impact the photocathode 20 photoelectrons are emitted at locations and in numbers replicative of the received optical energy of the scene being viewed. In general, the image received will be too dim to be viewed with human natural vision, and may be entirely or partially of infrared radiation which is invisible to the human eye. It is thus understood that the shower of photoelectrons emitted from the photocathode is in a pattern representative of the image entering the forward end of $I^2T$ 14. The path of a typical photoelectron emitted from the photon input point on the photocathode 20 is represented in FIG. 1 by dashed line 40.

Photoelectrons 40 emitted from photocathode 20 gain energy through an electric field of predetermined intensity gradient established between photocathode 20 and electron-receiving face 28, which field gradient is provided by power source 42. This power source is diagrammatically illustrated as being provided by batteries, although those ordinarily skilled will understand that an electronic circuit, perhaps powered by one or more batteries is generally employed. Typically, power source 42 will apply an electrostatic field voltage on the order of about 200 to about as much as 3000 volts to create a field of the desired intensity. After accelerating over a distance between the photocathode 20 and the input surface 28 of the microchannel plate 22, these photoelectrons 40 enter microchannels 32 of micro-channel plate 22. As will be discussed in greater detail below, the photoelectrons 40 are amplified by emission of secondary electrons to produce a proportionately larger number of electrons upon passage through micro-channel plate 22. This amplified shower of secondary-emission electrons 44, also accelerated by a respective electrostatic field generated by power source 46, then exits microchannels 32 of microchannel plate 22 at electron-discharge face 30.

Once in free space again, the amplified shower of photoelectrons and secondary emission electrons is again accelerated in an established electrostatic field provided by power source 48. This field is established between the electron-discharge face 30 and display electrode assembly 24. Typically, the power source 48 produces a field on the order of 3,000 to 7,000 volts, and more preferably on the order of 6,000 volts in order to impart the desired energy to the multiplied electrons 44.

The shower of photoelectrons and secondary-emission electrons 44 (those ordinarily skilled in the art will know that considered statistically, the shower 44 is almost or entirely devoid of photoelectrons and is made up entirely or almost entirely of secondary-emission electrons. That is, statistically, the probability of a photoelectron avoiding absorption in the microchannels 32 is low). However, the shower 44 is several orders of magnitude more intense than the initial shower of photoelectrons 40, but is still in a pattern replicating the image focused on photocathode 20. This amplified shower of electrons falls on the phosphor screen 26 of display electrode assembly 24 to produce an image in visible light.

Figure 2:
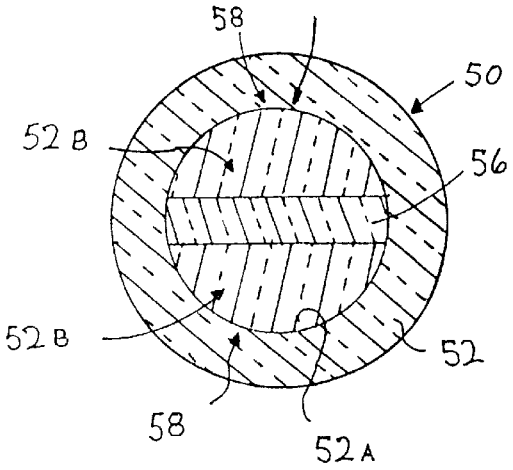
Figure 3:
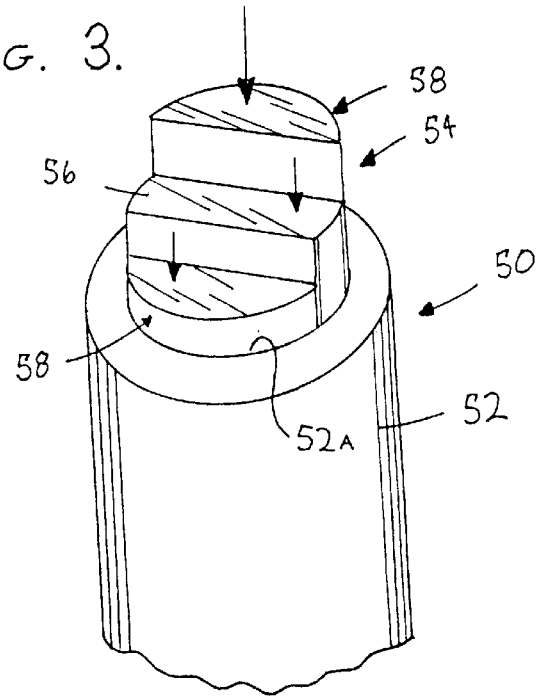
Figure 4:
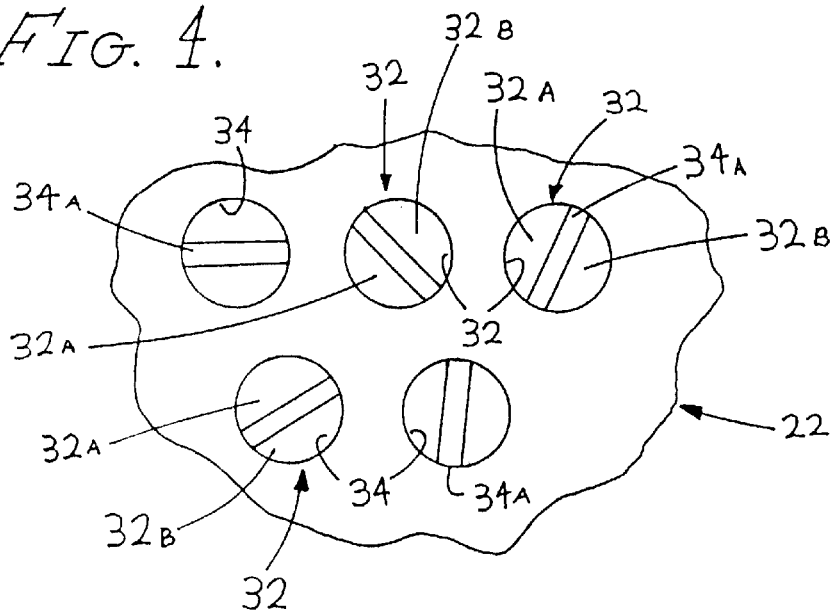

Viewing now FIGS. 2, 3, and 4 in conjunction, and considering first FIG. 4, it is seen that MCP 22 includes an array of microchannels 32, each of which is shaped substantially as a half-round segment of a circle, and is one of a group of two microchannels cooperatively making up substantially a complete circle. That is, the microchannels 32 are defined in pairs or groups, each including a microchannel 32*a* and a microchannel 32*b*. Between the microchannels 32*a* and 32*b* extends a wall portion 34*a*, which in this case is essentially a straight web of cladding glass bisecting a circular passage (i.e., a passage that otherwise would be a single microchannel of round shape and of larger size than channels 32*a* and 32*b*.

In order to make the microchannel plate seen in FIG. 4, and as is seen in FIGS. 2 and 3, the present manufacturing process involves making up a fiber pre-form which includes an elongate tube 52 of cladding glass having a bore 52*a*, and a core assembly 54 fitted into the bore 52*a*. The core assembly 54 is considerably in contrast to the conventional simple core of a fiber pre-form (which is simply a rod of core glass). That is, the core assembly 54 includes a partition member 56 formed of cladding glass like the tube 52. In this case, the partition member 56 bisects the bore 52*a*. On each side of the partition member 56 one of a pair of segment-shaped filler members 58 are fitted into the bore 52*a*. The filler members are complimentary to the bore 52*a* and partition member 56 so that the bore 52*a* is substantially filled by core assembly 54. The filler members 58 are formed of core glass (i.e., of etchable glass).

As is seen in FIG. 3, the partition member 56 and filler members 58 are preformed, and are slipped into the tube 52, as is indicated by the arrows on FIG. 3. Subsequently, the fiber pre-form 50 is fused (as was explained above); is drawn into multiple lengths of fiber of considerably smaller sized; is bunched into bundles; and is fused multifibers. These multifibers are bunched into a glass tube along with other filler glass pieces and are vacuum-fused at elevated temperature into a boule. The fused boule is sliced transversely into plural microchannel work pieces. These manufacturing steps (and others that follow to make the completed microchannel plate) will be well understood to those ordinarily skilled in the pertinent arts. However, it will be appreciated, that after the boule is fused and sliced into separate microchannel plate work pieces, and after the core glass (i.e., the then-smaller remnant of core-glass filler members 58) is etched out, then microchannels as are shown in FIG. 4 remain in the microchannel plate. That is, the fiber pre-form seen in FIG. 2 provides a 2:1 microchannel-to-fiber ratio.

Having considered the structure and manufacturing method for the embodiment of microchannel plate seen in FIGS. 2–4, attention may now be given to two alternative embodiments which each have the advantage of offering finer resolution, an increased number of microchannels in a microchannel plate made according to this invention, or a number of microchannels comparable to conventional technology with a decreased manufacturing burden. In order to obtain reference numerals for use in describing FIGS. 5 and 6, features which are the same or which are analogous in structure or function are indicated using the same numeral used above, and having one or two primes added (i.e., 'or" is added following the numeral used above).

Figure 5:
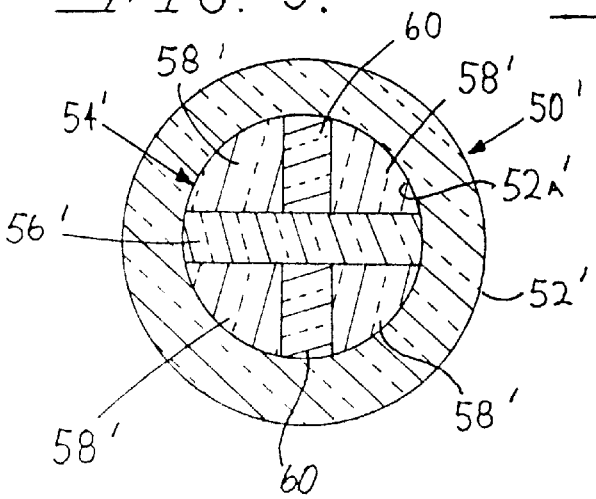

Viewing FIG. 5, it is seen that a fiber pre-form has a tube 52' made of cladding glass and defining a bore 52*a*'. Fitted into the bore 52*a*' in preparation to fusing and drawing of the fiber pre-form (i.e., into a fiber) is a core assembly 54'. In this case, the core assembly 54' includes a partition member 56' bisecting the bore 52*a*'. That is, as seen above, the partition member 56' divides the bore 52' in half into a pair of segment-shaped portions 52*b*. The core assembly 56' also includes a pair of aligned sub-partition members 60, which each respectively divide a respective one of the segment-shaped portions 52*b* of bore 52, again in half. Fitted into the resulting segment-shaped remaining areas of bore 52' (in this case, quarter-segment shaped remaining areas) are respective segment-shaped filler members 58'. Again, the filler members 58' are complimentary to the partition and sub-partition members of the core assembly 54' so that the bore 52' of the tube 52' is substantially filled. Thus, the core assembly 54' seen in FIG. 5 substantially fills the bore 52*a*' of the tube 52', and provides a 4:1 microchannel-to-fiber ratio in the finished microchannel plate made from the fiber pre-from of FIG. 5.

Figure 6:
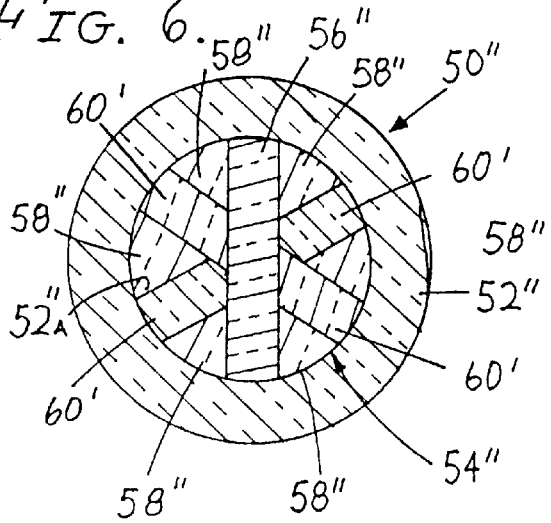

Finally, another exemplary alternative embodiment of the present invention is seen in FIG. 6. Recalling the explanation above it will be recalled that double primed numbers are used to indicate features that by now will be familiar to the reader. Viewing FIG. 6, it is seen that a fiber pre-form has a tube 52" made of cladding glass and defining a bore 52*a*". Fitted into the bore 52*a*" in preparation to fusing and drawing of the fiber pre-form (i.e., into a fiber) is a core assembly 54". In this case, the core assembly 54" includes a partition member 56" bisecting the bore 52*a*". That is, as seen and explained above, the partition member 56" divides the bore 52" in half into a pair of segment-shaped portions 52*b*' (indicated by the arcuate arrows delimiting these segment-shaped portions). However, in this case, the core assembly 56" includes a four sub-partition members 60', each pair of which respectively divides one of the segment-shaped portions 52*b*' of bore 52, into two pie-shaped portions (i.e., still essentially segments of a circle, but not a half circle as seen in FIG. 2 or a quarter circle as seen in FIG. 5). Fitted into the resulting segment-shaped remaining areas of bore 52" (in this case as explained, shaped substantially as one-sixth of a circle) are respective segment-shaped filler members 58". Again, the filler members 58" are complimentary to the partition and sub-partition members of the core assembly 54" so that the bore 52" of the tube 52" is substantially filled. Thus, the core assembly 54" seen in FIG. 6 substantially fills the bore 52*a*" of the tube 52", and provides a 6:1 microchannel-to-fiber ratio in the finished microchannel plate made from the fiber pre-from of FIG. 6.

Those skilled in the art will appreciate that the embodiment of the present invention depicted and described herein and above is not exhaustive of the invention. For example, other and different configurations of core assemblies can be used to subdivide the bore of a tube of cladding glass into sub-areas which are occupied by a filler member of core glass and separated from one another by a partition of cladding glass. For example, a fiber might be made from an elongate core assembly member extruded of cladding glass with five evenly spaced-apart webs. Each pair of the webs would define a one-fifth circle segment-shaped opening. Into these openings complimentary filler pieces of core glass would be fitted to make a core assembly providing a 5:1 microchannel-to-fiber ratio in a microchannel plate made from such a fiber.

Those skilled in the art will further appreciate that the present invention may be embodied in other specific forms without departing from the spirit or central attributes thereof. Because the foregoing description of the present invention discloses only particularly preferred exemplary embodiments of the invention, it is to be understood that other variations are recognized as being within the scope of the present invention. Accordingly, the present invention is not limited to the particular embodiment which has been described in detail herein. Rather, reference should be made to the appended claims to define the scope and content of the present invention.

I claim:

1. A microchannel plate comprising:

a plate-like glass body having a pair of opposite faces, said plate-like glass body defining a multitude of microchannels extending therethrough, each microchannel opening at opposite ends on a respective one of the opposite faces of the body, each microchannel being bounded by a wall portion of the glass body, which wall portion is substantially a circular segment.

2. The microchannel plate of claim 1 wherein each microchannel is one of a group of microchannels cooperatively defining substantially a complete circle.

3. The microchannel plate of claim 1 wherein each microchannel is further bounded by a portion of a partition member, which partition member extends generally diametrically across said substantially complete circle.

4. The microchannel plate of claim 3 wherein said group of microchannels includes four microchannels, and said group of microchannels includes a first partition member extending diametrically of said substantially complete circle, and a second partition member extending substantially perpendicularly to the first partition member.

5. The microchannel plate of claim 3 wherein said group of microchannels includes an even number of microchannels more than four, and a like number of partition members or portions of a partition member, which partition members or portions thereof each extend radially from substantially at a center of said substantially complete circle to said wall bounding said microchannels of the group and which is substantially a circular segment.

6. A microchannel plate comprising:

a plate-like glass body having a pair of opposite faces, said plate-like body defining a multitude of microchannels extending therethrough, each microchannel opening at opposite ends on a respective one of the opposite faces of the body, said plate-like glass body including a wall portion which bounds and circumscribes plural groups of microchannels, and which wall portion is substantially circular about each one of said plural groups of microchannels.

7. The microchannel plate of claim 6 wherein said wall portion also includes a multitude of integral partition portions each of which are substantially straight and bisect a substantially circular group of microchannels.

8. A night vision device having an objective lens receiving light from a scene being viewed and directing this light to an image intensifier tube, said image intensifier tube providing a visible image of the scene being viewed, and an eyepiece lens providing this visible image to a user of the night vision device; said image intensifier tube including a photocathode receiving photons from the scene and releasing photoelectrons in a pattern replicating the scene, a microchannel plate receiving the photoelectrons and providing a shower of secondary emission electrons in a pattern replicating the scene, and a screen receiving the shower of secondary emission electrons and producing a visible image replicating the scene; said night vision device including a source of electrical power at a selected voltage level, and a power supply circuit receiving said electrical power at said selected voltage level to responsively provide higher voltage levels to said photocathode, to opposite faces of said microchannel plate, and to said screen; wherein said microchannel plate includes a glass body having a pair of opposite faces and defining a multitude of microchannels extending therethrough, each microchannel opening at opposite ends on a respective one of the opposite faces of the body, each microchannel being bounded by a boundary wall portion of the glass body, and this boundary wall portion is substantially a circular segment.

9. An image intensifier tube, said image intensifier tube providing a visible image of the scene being viewed, and including a photocathode receiving photons from a scene and releasing photoelectrons in a pattern replicating the scene, a microchannel plate receiving the photoelectrons and providing a shower of secondary emission electrons in a pattern replicating the scene, and a screen receiving the shower of secondary emission electrons and producing a visible image replicating the scene; said microchannel plate of said image intensifier tube having plural groups of microchannels, each of said plural groups of microchannels each including plural microchannels, each group of microchannels cooperatively defining a substantially circular area on a face of the microchannel plate.

10. A method of making a microchannel plate, said method comprising steps of:

providing a fiber pre-form having a tubular body formed of cladding glass which can be electrically active as an emitter of secondary electrons, and a core assembly;

including in said core assembly a member of cladding glass and a member of core glass.

11. The method of claim 10 further including the step of configuring said member of cladding glass to extend diametrically of said tubular body.

12. The method of claim 10 further including the steps of configuring said tubular body to define a bore extending lengthwise thereof, and configuring said member of core glass to extend both lengthwise of said tubular body and to fill a circular segment shaped portion of said bore of said tubular body.

13. The method of claim 10 further including the steps of fusing said tubular body and said core assembly into a unitary fiber, and thereafter removing said member of core glass.

14. The method of claim 13 further including the steps of providing a multitude of said unitary fibers each of which includes a said member of core glass respective to each one of said multitude of unitary fibers, arranging said multitude of unitary fibers in parallel side-by-side arrangement with one another, and fusing said multitude of unitary fibers into a unitary whole.

15. The method of claim 14 further including the step of removing said members of core glass from said multitude of unitary fibers simultaneously and after fusing of said unitary whole.

16. A method of making a microchannel plate which includes the steps of providing a great multitude of fused fibers each of which includes a tubular body of cladding glass and a core assembly, providing in said core assembly a member of core glass and a member of cladding glass which are fused to one another and to the respective tubular body of the fused fiber, fusing said great multitude of fused fibers to one another to make a fused boule, and thereafter removing the respective members of core glass from each of said fused fibers of said fused boule.

17. The method of claim 16 further including the step of making each one of said fused fibers define a group of microchannels, which group of microchannels cooperatively define substantially a complete circle.

18. The method of claim 17 further including the step of having each microchannel of a group of such microchannels be further bounded by a portion of a partition member, which portion of said partition member is formed of cladding glass provided by said member of cladding glass of said core assembly and extends generally diametrically across said substantially complete circle.

* * * * *